United States Patent [19]

Hart

[11] Patent Number: 4,735,448

[45] Date of Patent: Apr. 5, 1988

[54] MANUALLY OPERATED WINCH BUMPER

[76] Inventor: Howard M. Hart, 1304 NW. 53rd St., Vancouver, Wash. 98663

[21] Appl. No.: 839,503

[22] Filed: Mar. 14, 1986

[51] Int. Cl.[4] ..... B61F 19/04

[52] U.S. Cl. ..... 293/117; 254/323; 254/376

[58] Field of Search ..... 293/1, 117; 254/323, 254/325, 326, 327, 376

[56] References Cited

U.S. PATENT DOCUMENTS

| | | | |
|---|---|---|---|
| 1,378,926 | 5/1921 | Wienke | 254/376 |
| 1,508,750 | 9/1924 | Nabors | 254/323 |
| 2,213,840 | 9/1940 | Hoecker | 293/111 |
| 2,294,757 | 9/1942 | Larsen et al. | 254/323 |
| 2,470,242 | 5/1949 | Felsing | 254/323 |
| 3,539,152 | 11/1970 | Paul et al. | 254/323 |
| 3,946,991 | 3/1976 | Eriksson | 254/323 |
| 4,127,295 | 11/1978 | Robinson | 293/117 |
| 4,159,833 | 7/1979 | Meiners | 293/117 X |
| 4,266,817 | 5/1981 | Mason et al. | 293/117 |
| 4,331,323 | 5/1982 | Sekimori et al. | 254/323 |
| 4,419,038 | 12/1983 | Pendergraft | 414/543 |

*Primary Examiner*—Robert B. Reeves
*Assistant Examiner*—Russell D. Stormer
*Attorney, Agent, or Firm*—Klarquist Sparkman Leigh

[57] ABSTRACT

A manually operated winch bumper is mountable to the rear of a vehicle. A winch drum is rotatably carried by the bumper and provided with a pair of coaxial shafts projecting in opposite directions from the winch to the ends of the bumper. The winch can be manually operated with a crank from either end of the bumper by insertion of the crank into sockets provided at the outer ends of the shafts. A third socket is provided for one of the shafts adjacent the winch drum such that the winch can also be operated from a position intermediate the ends of the bumper. Placement of the winch at the rear of the vehicle helps in pulling it out of terrain in which it is stuck since the vehicle will be pulled out from the direction it entered. Provision of crank sockets at either end and in the middle of the bumper allows manual operation of the winch even in an environment where shrubbery or other obstacles prevent access to portions of the bumper.

6 Claims, 2 Drawing Sheets

MANUALLY OPERATED WINCH BUMPER

BACKGROUND OF THE INVENTION

1. Field of the Invention

The present invention concerns a manually operated winch bumper for vehicles.

2. General Discussion of the Background

Electric winches have previously been mounted on some vehicles. It has been especially popular to place such powered winches on pickup trucks and other rough terrain vehicles to help extricate the vehicle from muddy or other treacherous terrains in which the vehicle becomes mired. In such a situation, the free end of a winch cable is attached to a stationary object and the winch actuated to wind in the cable and pull the vehicle out of the treacherous terrain. It has been conventional, however, to mount such winches at the front of the vehicle, thereby making it necessary to extricate the vehicle by pulling it in the direction it was headed before it became mired. This can sometimes be a drawback if rocks or other obstacles are located in front of the vehicle. The path behind a vehicle is usually clear since the vehicle had to travel over that path to reach its mired position.

Another problem with conventional vehicle-mounted winches is that they are usually power actuated. Although such power operation is a convenience, it greatly increases the cost, weight, and size of the winch attachment. It is often difficult to justify such factors since most vehicle-mounted winches are only occasionally used.

U.S. Pat. No. 4,127,295 discloses a truck bumper with a power-actuated cable winch unit. This bulky structure illustrates the problem of the prior art in which an expensive, space-consuming structure is mounted to the front of a vehicle. Although the winch is intended only for occasional use, the power-actuated winch bumper can increase the cost of a vehicle by several thousand dollars. In addition, it is difficult to pull the vehicle backward with the winch. Although the front-mounted bumper is provided at one end with a roller that permits attachment of the winch cable to a point behind the truck, rearward pulling of the truck about the roller will be accompanied by a torque that tends to rotate the vehicle as it moves backward.

Additional problems of the prior art are illustrated by U.S. Pat. No. 4,419,038. This patent shows a bumper-mounted, foldable crane hoist for attachment to the rear of a vehicle. The boom has a hoist line which is secured to a motor-driven or crank-operated takeup reel in the bumper. This reel is positioned at one end of the bumper, which would present a serious impediment to manual operation of the reel in a situation where bushes or other obstacles were close to the end of the bumper at which the takeup reel is mounted.

U.S. Pat. No. 4,331,323 discloses a power-actuated winch system for connection to the electrical system of an automobile. The winch requires a motor and electrical connections for operation, thereby increasing the system's cost, complexity of installation and use.

All of these structures illustrate serious drawbacks of the prior art discussed above.

Accordingly, it is an object of the present invention to provide a manually operated winch bumper which is less expensive and bulky than prior art winches attached to vehicles.

Another object is to provide a winch bumper which can be easily and inexpensively installed on vehicles.

It is yet another object of the invention to provide a winch bumper which can pull mired vehicles out of rough terrain by pulling them in the direction from which they entered the terrain without tending to rotate the vehicle body.

It is still another object of the invention to provide a manually operated winch bumper that can be operated from several different positions along the bumper in the event one of the operating positions is obstructed by brush, rocks, or other obstacles.

Finally, it is an object to provide a winch bumper which protects the body of the winch component of the bumper and the vehicle to which the bumper is attached.

SUMMARY OF THE INVENTION

The aforementioned objects are achieved by providing a manually operated winch bumper for mounting on a vehicle frame. The winch bumper includes a protective bumper portion which protects both the winch and the vehicle. A manually operable winch drum is rotatably carried by the bumper intermediate its ends. The winch drum is provided with winch-operating means, such as a shaft extending from the winch drum longitudinally through the bumper. In some embodiments, a pair of shafts extend from opposite ends of the winch drum.

In preferred embodiments, the winch-operating means is provided with a socket adjacent the end of the bumper into which a crank can be placed for rotating the winch drum. An intermediate winch-operating means can also be provided adjacent the winch drum so that the drum can be rotated from a midportion of the bumper as well.

BRIEF DESCRIPTION OF THE DRAWINGS

The invention will be better understood from the following description taken in connection with the accompanying drawings in which.

DETAILED DESCRIPTION OF THE PREFERRED EMBODIMENT

The following detailed description of a preferred embodiment is being made in accordance with requirements of law. This detailed description is not intended to restrict the scope of protection, which is more appropriately construed in accordance with the appended claims.

Figure 1:
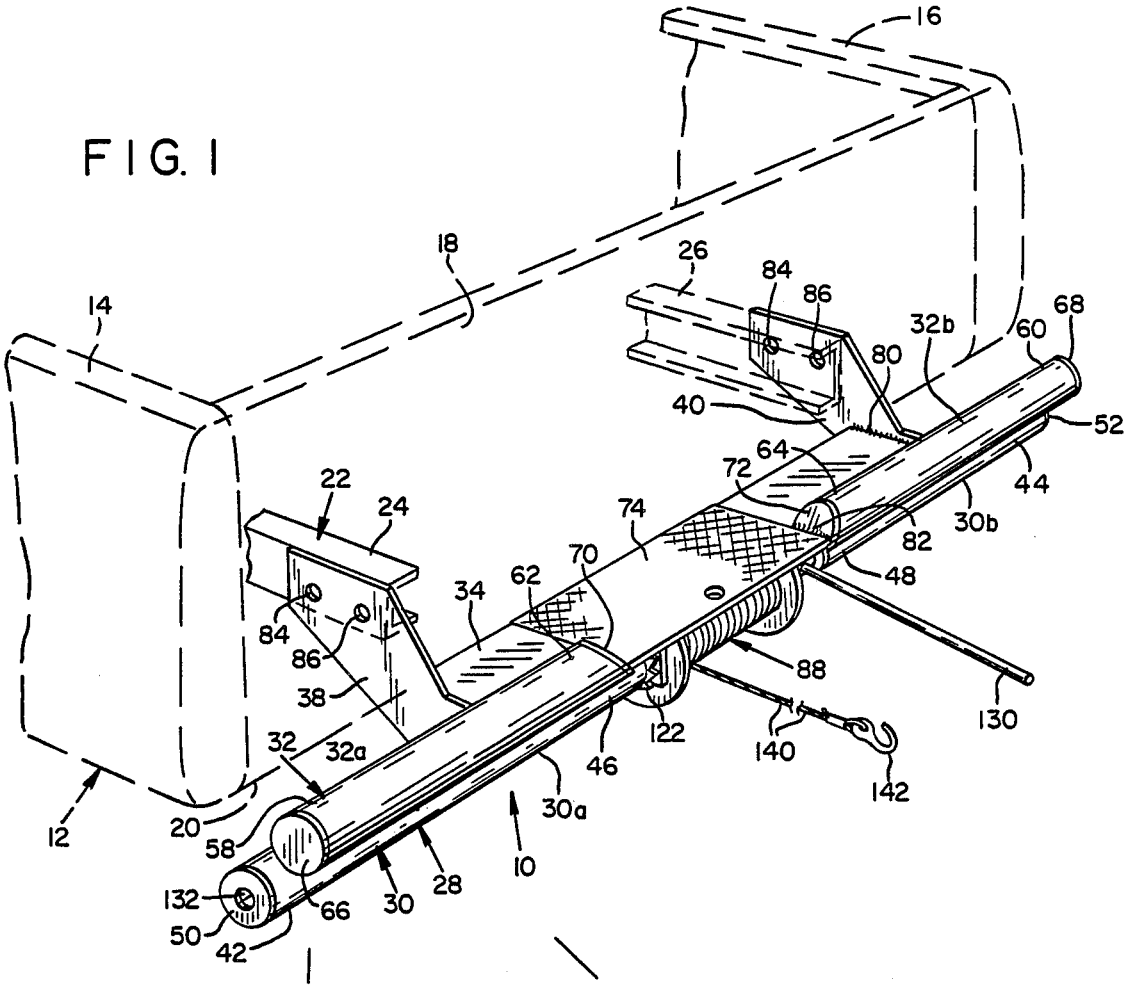
FIG. 1 is a perspective view of the manually operated winch bumper of the present invention attached to the rear of a vehicle, the vehicle being shown in phantom.

As shown in FIG. 1, a manually operated winch bumper 10 is provided for a vehicle 12, such as a pickup truck having side panels 14, 16, rear gate 18, bottom rear edge 20, and a frame 22. The frame 22 typically has two longitudinal frame members 24, 26, and a cross frame member (not shown).

A bumper means such as bumper 28 comprises a lower tube 30 and upper tube 32 held in parallel spaced relationship to each other by being welded to perpendicular protective plates 34, 36 and parallel attachment brackets 38, 40. When bumper 28 is attached to the vehicle, upper tube 32 is slightly below the bottom rear edge 20 of vehicle 12.

Lower tube 30 includes axially spaced segments **30*a*, 30*b* each segment having an outer end 42, 44 and an inner end 46, 48. The outer end of each segment is covered with a cap 50, 52 having a central circular opening therethrough. The inner end of each segment is similarly covered with a cap 54, 56** having a central circular opening.

Upper tube 32 includes axially spaced segments **32*a*, 32*b*, each segment having an outer end 58, 60 and an inner end 62, 64. The outer end of each segment is covered with a cap 66, 68, and the inner end of each segment is covered with a cap 70, 72. An armor plate 74 is welded to plate 34 between inner ends 62, 72 of upper tube 32**.

Figure 4:
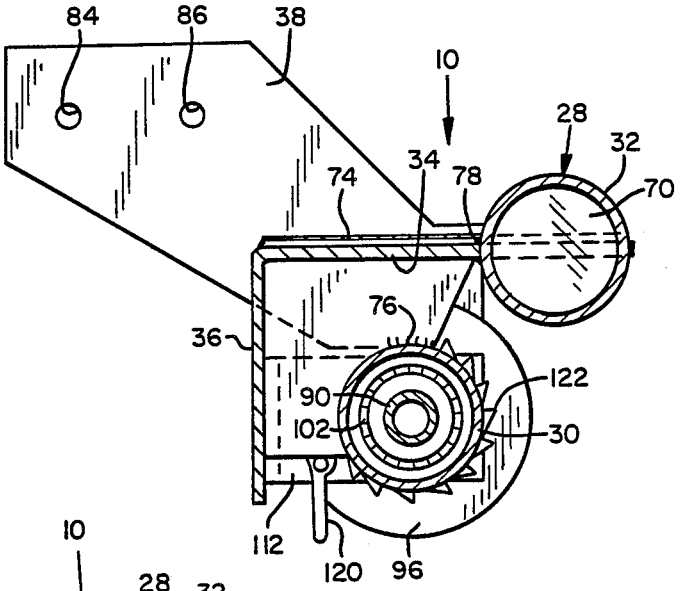
FIG. 4 is a cross-sectional view of the bumper taken along section lines 4—4 of FIG. 3.

The tubes 30, 32 are welded to perpendicular support plates 34, 36 and parallel brackets 38, 40 at welds 76, 78 (FIG. 4) and 80, 82 (FIG. 1). The brackets 38, 40 are in turn attached to the outside of opposite longitudinal members 24, 26 of frame 22 with bolts (not shown) through a pair of holes 84, 86 in each bracket.

Figure 3:
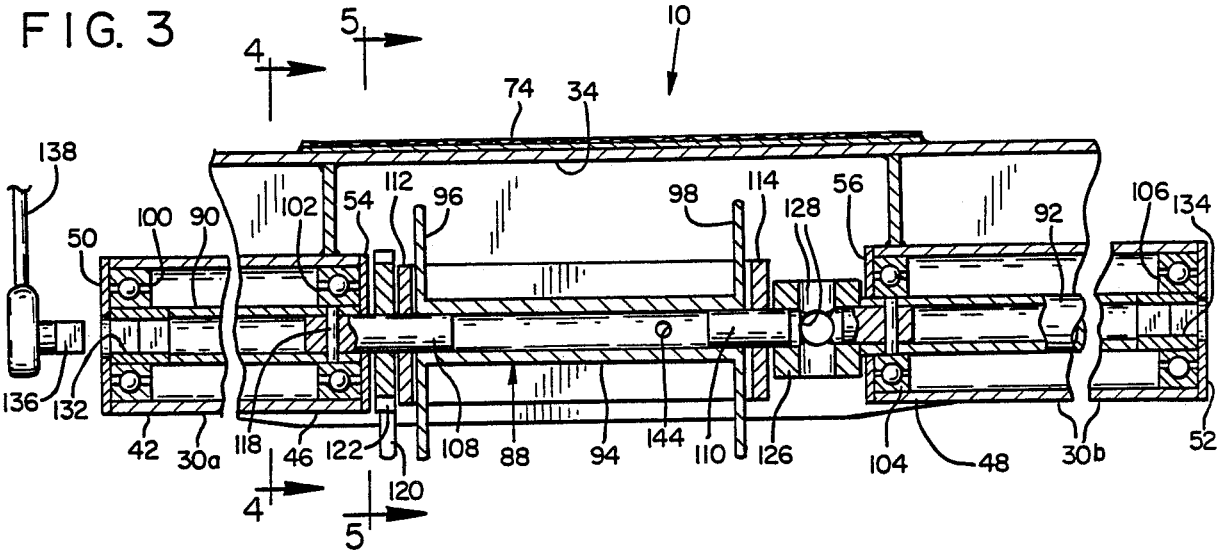
FIG. 3 is a foreshortened vertical sectional view showing the internal structure of the winch-mounting bumper tube of the bumper and the protective structure around the tube.

Winching means for bumper 28 includes a winch drum 88 with a pair of shafts 90, 92 extending from opposite sides of the winch drum through lower tube 30. Drum 88 comprises a tubular arbor 94 (FIG. 3) between a pair of opposing circular end plates 96, 98. Shafts 90, 92 extend in opposite directions from drum 88 through lower bumper tube segments **30*a*, 30*b* to the ends 42, 44 of lower tube 30, the shafts being secured in axial alignment with drum 88** as described below.

Each end of shaft 90 is rotatably centered within lower tube 30 by a pair of bearing structures 100, 102. Bearing structure 100 is press fit within end 42 of segment **30*a* immediately interior to cap 50. Bearing structure 102 is similarly press fit within segment 30*a* immediately interior to cap 54. On the opposite side of winch drum 88, shaft 92 is rotatably centered within segment 30*b* by a pair of bearing structures 104, 106 which are press fit immediately adjacent and interior to caps 56, 52**.

Figure 5:
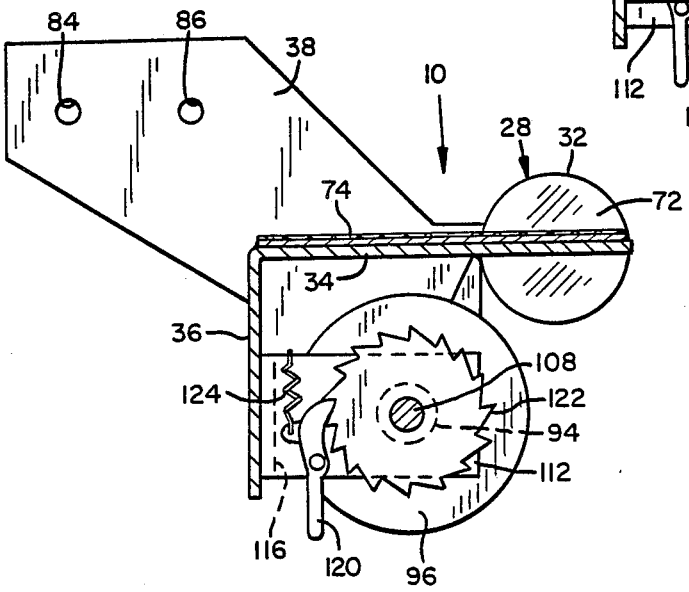
FIG. 5 is a cross-sectional view of the bumper taken along section lines 5—5 of FIG. 3.

Winch drum 54 is connected to rotatable shafts 90, 92 by extensions 108, 110 extending from arbor 94. The extensions 108, 110 are rotatably supported by arms 112, 114 of a mounting bracket 116 which is welded to the underside of plate 34 beneath armor plate 74. Extension 108 is connected to shaft 90 by a connection pin 118. A pawl 120 and ratchet 122 are fixed around extension 108 between bracket arm 112 and cap 54, with spring 124 (FIG. 5) biasing pawl 120 into engagement with ratchet 122 to allow free rotation of drum 88 in only one direction.

A cylindrical, intermediate, crank-receiving socket member 126 (FIG. 3) is fixed to extension 110 between cap 56 and bracket arm 114. A pair of mutually perpendicular through bores, such as bore 128, extend through socket member 126 and are sized to snugly receive an intermediate crank rod 130 (FIGS. 1 and 2) so that drum 88 can be rotated with the rod.

An end socket 132, 134 is also provided within the outer end of each shaft 90, 92, immediately inwardly of the hole in each end cap 50, 52. The socket openings have a noncircular cross-sectional shape and dimension corresponding to the shape and dimension of projection 136 on crank 138 to receive such projection. The end sockets shown are square.

Figure 2:
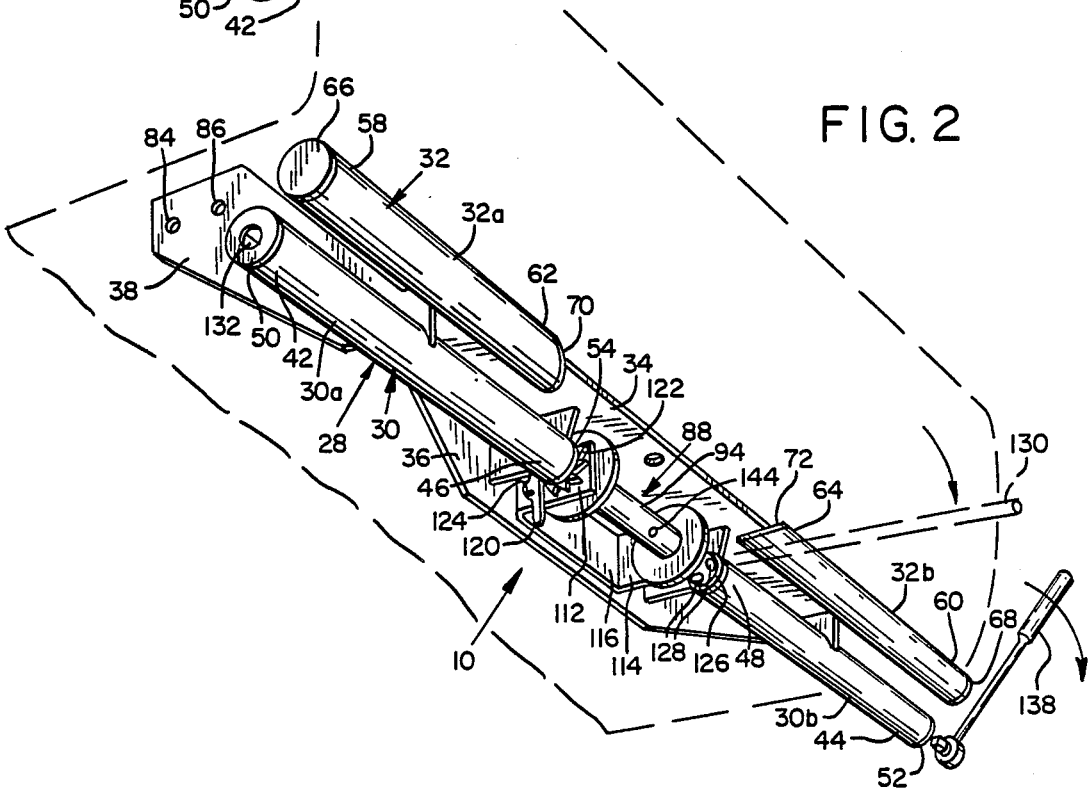
FIG. 2 is a bottom perspective view of the winch bumper shown in FIG. 1.

A winch cable 140 (FIG. 1) is wound on the arbor of the winch drum. It has a hook 142 attached at one end and is anchored to arbor 94 at its other end. FIG. 2 shows an anchor hole 144 into which an end of cable 140 can be inserted and knotted for retention.

In operation, a mired vehicle which is stuck in mud can be pulled free by first releasing the vehicle's brake and putting its transmission in a neutral gear. Cable 140 is then unwound from drum 88 by releasing spring-biased pawl 120 from engagement with ratchet 122 and pulling on the cable to rotate drum 88 in a counterclockwise direction in FIGS. 4 and 5. Hook 142 is then attached to a tree or other stationary object in back of vehicle 12. With the pawl engaging ratchet 122, cable 140 is wound onto winch drum 88 by inserting projection 136 of crank 138 into end socket 132 or 134 and rotating crank 138 so that the attached shaft 90 or 92 turns and rotates winch drum 88 in a clockwise direction in FIGS. 4 and 5. As drum 88 turns clockwise, pawl 120 is continuously biased by spring 124 against ratchet 122 such that the drum will turn in the clockwise direction only. Cable 140 will be drawn in as long as crank 138 is turned clockwise.

Winch drum 88 can also be turned by placing crank rod 130 through one of bores 128 and exerting force on the crank rod. Crank 138 is preferably used at sockets 132 or 134 to take slack out of cable 140, then crank rod 130 used to perform the remainder of the winching operation.

Winch drum 88 can therefore be rotated from either end 42, 44 of lower tubular member 30, or from an intermediate position immediately adjacent winch drum 88. Close clearance or obstacles at any of the winching points can be avoided by choosing an alternate winching position on bumper 10. Variable torque can be applied simply by changing the effective length of the crank rod, that is, its distance from the axis of rotation.

The winch bumper can also be used to move heavy objects other than the vehicle itself. For example, vehicle 12 can be placed in a parking gear with the parking brake applied. After unwinding cable 140 from winch drum 88, hook 142 is attached to the object to be pulled by winch bumper 28. Drum 88 is then rotated in a clockwise direction with cranks 130, 138 as already described.

Winch bumper 10 is a relatively lightweight and inexpensive manually operated structure that provides protection for the winch means and the body of vehicle 12. Upper tube 32 protects against impact from other vehicles or objects, while lower tube 30 protectively carries the rotatable drum 88, shafts 90, 92 and bearing structures 100, 102, 104, 106 of the winching means.

Having illustrated and described the principles of the invention in a preferred embodiment, it should be apparent to those skilled in the art that the invention can be modified in arrangement and detail without departing from such principles. I claim all modifications coming within the spirit and scope of the following claims.

I claim:

1. A manually operated winch bumper for a vehicle, comprising:

a vehicle having a frame with a back end;

a bumper means attached to said back end of said frame;

said bumper means being comprised of a pair of stationary, elongated, axially aligned lower tubular members each having inner and outer ends, and an upper tubular member having outer ends and being mounted parallel to the lower tubular members;

a which drum rotatably carried between said lower tubular members;

a pair of axially aligned, longitudinally spaced shafts extending in opposite directions from said drum through the lower tubular members to the outer ends of said members, each of said shafts being rotatably carried in its respective tubular member;

each shaft further having an outer end disposed adjacent one of said outer ends of said lower tubular element, each outer end of said shafts having a crank-receiving opening coaxial with said shaft;

an intermediate crank-receiving means mounted on one of said shafts between said drum and one of said tubular elements;

attachment means for attaching said bumper means to the vehicle frame, a ratchet carried by said winch drum and a pawl carried by said bumper means for selectively allowing free rotation of said drum in only one direction.

2. The winch bumper of claim 1 wherein said winch drum is located at substantially the middle of the longitudinal length of said lower tubular element and said upper tubuluar element is interrupted in the region of said winch drum to allow access to said winch-operating means adjacent said drum.

3. The winch bumper of claim 1 further comprising a crank for insertion into said crank-receiving means.

4. The winch bumper of claim 1 where said upper tubular member is comprised of a pair of tubular elements joined by a step means.

5. The winch bumper of claim 1 where said upper tubular member is spaced further outwardly from said vehicle in relation to said lower element.

6. The winch bumper of claim 5 further comprising a crank for insertion into said crank-receiving means.

* * * * *